United States Patent [19]

Giflo

[11] 4,265,660

[45] May 5, 1981

[54] HIGH-STRENGTH FREE-CUTTING STEEL ABLE TO SUPPORT DYNAMIC STRESSES

[76] Inventor: Henrik Giflo, III Ujitok u.5, 3532 Miskolc, Hungary

[21] Appl. No.: 54,527

[22] Filed: Jul. 3, 1979

[51] Int. Cl.[3] ..... C22C 33/00

[52] U.S. Cl. ..... 75/123 B; 75/123 C; 75/123 E; 75/123 F; 75/123 G; 75/126 H; 75/123 N; 75/123 J; 75/123 K; 75/123 L

[58] Field of Search ..... 75/123 R, 123 B, 123 C, 75/123 E, 123 F, 123 G, 123 H, 123 N, 123 J, 123 K, 123 L

[56] References Cited

U.S. PATENT DOCUMENTS

| | | | |
|---|---|---|---|
| 4,115,11 | 9/1978 | Itch et al. | 75/123 F |
| 3,634,074 | 1/1972 | Ito et al. | 75/123 F |
| 4,004,422 | 1/1977 | Thivellier | 75/123 G |
| 4,043,807 | 8/1977 | Kirman | 75/123 J |

FOREIGN PATENT DOCUMENTS

| | | |
|---|---|---|
| 2246650 | 5/1975 | France . |
| 2281988 | 3/1976 | France . |
| 2338995 | 8/1977 | France . |
| 2395323 | 1/1979 | France . |

*Primary Examiner*—L. Dewayne Rutledge
*Assistant Examiner*—John P. Sheehan

[57] ABSTRACT

A free-cutting steel able to support dynamic stresses and exhibiting a high strength, even without hardening, and an excellent aptitude for machining by material removal, which is intended for making machine elements subjected to great stresses, which comprise, besides iron, 0.1 to 0.7% (by weight) of C, 1.2 to 3% (by weight) of Mn, at most 1% (by weight) of Si, at least 0.1% (by weight) of P, 0.05 to 0.15% (by weight) of S, at most 0.1% (by weight) of Pb, 0.001 to 0.03% (by weight) of Ca, 0.001 to 0.005% (by weight) of B, 0.007 to 0.035% (by weight) of N, 0.03 to 0.2% (by weight) of Nb and/or V, at most 0.25% (by weight of Zr and/or Ce, at most 0.2% (by weight) of Be and/or Bi, and at most 1% (by weight) of Mo and/or Ni.

3 Claims, No Drawings

HIGH-STRENGTH FREE-CUTTING STEEL ABLE TO SUPPORT DYNAMIC STRESSES

This invention relates to a free-cutting steel able to support dynamic stresses and exhibiting a high strength, even without hardening, and an excellent aptitude for machining by removal of material, which is intended for making, on machines working by removal of cuttings, high-strength machine elements intended to be put under great stress.

In the transformation technique, automatic machines working by material removal and the lines made up of these machines are modern and efficient means that make it possible to reduce operations and costs, in particular for mass production. But utilization of these automatic machines working by material removal is profitable for machining steels only when it is not necessary to provide constant supervision and the cuttings can be removed from the piece or machine without manual intervention. The materials used for making products by removal of cuttings must meet one important requirement, namely, a good capability for machining by material removal and give cuttings of a suitable shape for the automatic or free-cutting machines.

The capability for machining by material removal is a physical property of the materials, just as mechanical strength or density are, and is therefore characteristic of each material; it results from complex physical properties such as:

- the aptitude of the material for removal of cuttings,
- a property of the material guaranteeing a good quality of the surfaces by removal of the cuttings,
- the abrasive action of the material on the tool.

The aptitude for machining by material removal consequently involves, as a function of the manufacturing aims, the following characteristic parameters:

- cutting force or resistance,
- shape of the cuttings,
- quality of the surface worked by removal of cuttings,
- the cutting life of the cutting tool, or parameter corresponding to the combined concepts.

It is generally accepted that materials exhibiting an optimal aptitude for machining by material removal are those from which a maximal amount can be cut, in minimal time, by removal of cuttings, between two sharpenings of the tool, and with a suitable surface quality. Thus, the cutting yield, depending on the process intervening during cutting removal, is obtained from two factors that differ from one another:

- the properties of the material, and
- the characteristic conditions of the cutting removal.

In connection with what has just been said, special alloy, free-cutting steels have been developed and whose aptitude for machining by material removal has been considered.

The most important requirement that free-cutting steels should meet is that their machining by material removal should give cuttings of a suitable size and able automatically to be removed from the machine by the cooling liquid, without outside intervention. To impart good fragmenting characteristics to the cuttings, it has been necessary, in making free-cutting steels, to use alloy elements that are not put into solution in the iron or else only in a slight amount, which makes it possible, during cutting fragmentation, to take advantage of the action favorable to the formation of inclusions, which reduces friction between the metal surfaces.

Since the chip-breaking alloyed elements and surface lubricants actually constitute impurities of the steel, to a certain extent they govern the parameters of the mechanical properties of the free-cutting steels, and particularly the resistance to dynamic stresses and at times even their mechanical strength.

Improvement of the capability or aptitude for machining by material removal therefore involves a reduction or notable limitation of the useful properties of the steels. This is the reason it is not possible to use these economic machines which are automated for material removal, to produce machine elements intended to undergo stresses exceeding the aptitude of known free-cutting steels. Therefore, these steels are no longer able to meet present requirements of aptitude for machining by material removal and for stress and they can no longer be machined on profitable automatic machines.

However, a good aptitude for machining by material removal and with cuttings in a good shape constitutes, for a steel able to support great stresses, even without hardening, such an economic advantage not only for automatic machines but also for any mode of machining by cuttings removal, that the time and money devoted to output of the final product represents, under favorable conditions, only a fraction of present costs in time and money.

Therefore, it has become essential to develop a new free-cutting steel whose mechanical strength, obtained without hardening, to meet the above mentioned needs of machine elements, whose resistance to dynamic stresses is sufficient and meets present requirements, and which exhibits a good aptitude for machining by material removal, with cuttings of a suitable shape for automatic machines.

Presently known free-cutting steels that exhibit a good aptitude for machining by material removal can be divided into three groups:

1. steels of the first group cannot be subjected to a heat treatment,
2. those of the second group can undergo a hardening during their utilization, and
3. finally those of the third group can undergo a hardening treatment or hardening followed by tempering.

By way of example, there can be mentioned the following steels that belong to the three groups:

United States: MK 1213 Ledley, Multikut;
Federal Republic of Germany: 9SMnPb 36, 10 SPb and 60 S 20;
Italy: 10 S 22, 40 SMnPb 10;
Hungary: AS 5, ABS 2, ANS 3.

These steels generally contain 0.07 to 0.65% (by weight) of C, at most 0.40% (by weight) of Si, 0.30 to 1.10% (by weight) of Mn, 0.15 to 0.40% (by weight) of S, at most 0.10% (by weight) of P; in addition, some grades further contain at most 0.15% (by weight) of Pb, 0.80 to 1.50% (by weight) of Cr, 0.15 to 0.50% (by weight) of Mo and 0.05% (by weight) of Se.

The mechanical properties of these steels vary as a function of the group of heat treatments applied.

The parameters of steels have not undergone heat treatment were used as a basis of comparison. The tensile strength of these steels is, without cold deformation, between 290 and 900 $N/mn^2$ and in the cold drawn state it is between 370 and 1100 $N/mn^2$ (da $N/mn^2$), values to which correspond an apparent elastic limit between 24 and 6 (da $N/mn^2$) and an elongation between 5 and 10%.

These steels exhibit the drawback of having a resistance to dynamic stresses or a tendency to fragility that are unsatisfactory, because of the nature and amount of the additive material intended to improve the aptitude for machining by material removal, which in the end limits their utilization. The various alloy elements that are added to improve the aptitude for machining by material removal cause such a great reduction of some of the useful properties of these known free-cutting steels that their utilization as mechanical construction steels is considerably limited, as a function of the stresses the machine elements must undergo during operation.

A group of now known free-cutting steels therefore exhibits a relatively good mechanical strength, which can be adjusted to desired values by hardening or tempering, but the plasticity of these steels and their resistance to dynamic stresses no longer meet present requirements.

This invention has for its object the development of such a high-strength steel, exhibiting an excellent aptitude for machining by material removal and intended for making machine elements subjected to great stresses, a steel that not only exhibits, without hardening, a high resistance to dynamic stresses but which further can be machined with formation of cuttings suitable for automatic machines.

This invention makes it possible to achieve this objective by the fact that the steel made according to this invention contains, besides iron, 0.10 to 0.70% (by weight) of C, 1.20 to 3.00% (by weight) of Mn, at most 1.00% (by weight) of Si, at most 0.1% (by weight) of P, 0.05 to 0.15% (by weight) of S, at least 0.10% (by weight) of Pb, 0.001 to 0.03% (by weight) of Ca, 0.001 to 0.005% (by weight) of B, 0.007 to 0.035% (by weight) of N, 0.01 to 0.20% (by weight) of Nb and/or V, at most 0.25% (by weight) of Zr and/or Ce, at most 0.20% (by weight) of Be and/or Bi and at most 1.00% (by weight) of Mo and/or Ni.

A particularly preferred composition according to the invention comprises, besides iron the elements in the following proportions.

| | | | |
|---|---|---|---|
| C | 0.10-0.70% | V | 0.01-0.15% |
| Mn | 1.20-2% | Zr | 0.01-0.15% |
| Si | 0.1-1% | Mo | 0.01-0.5% |
| P | 0.0-0.10% | B | 0.001-0.005% |
| S | 0.05-0.15% | Bi | 0.001-0.005% |
| Pb | 0.1-0.4% | Ca | 0.001-0.01% |
| Nb | 0.01-0.15% | N | 0.007-0.035% |

As may be seen from the foregoing, the broad range for the various components indicated is as follows:

| | | | |
|---|---|---|---|
| C | 0.1-0.7% | B | 0.001-.005% |
| Mn | 1.2-3% | N | .007-0.035% |
| Si | 0.1-1% | Nb/V | 0.01-0.2% |
| P | 0-0.10% | Zr/Ce | 0.01-0.25% |
| S | 0.05-0.15% | Be/Bi | 0.001-0.2% |
| Pb | 0.1-0.6% | Mo/Ni | 0.01-1% |
| Ca | 0.001-0.03% | | |

Some of the alloy elements assure the steel, when they are in the ratio according to the invention and without hardening, has a sufficient mechanical strength, while retaining for it the necessary plasticity; other alloy elements assure the cutting a suitable fragmentation capability, without entailing a reduction in the resistance of the steel to dynamic stresses, and said steel according to this invention also contains alloy elements that contribute to an increase in the lubricating power of the metal surfaces in contact with one another, and thereby, contribute to the excellent aptitude of this steel to machining by material removal.

Because of its chemical composition, the steel according to this invention exhibits a relatively high mechanical strength, even in the rolled state, so that one sizing stand suffices to achieve the section necessary for automatic removal of cuttings and which can eliminate section reduction which has had to be preformed until now to assure the free-cutting steel a suitable mechanical strength and which required much work.

Despite its high strength, the steel according to the invention exhibits an excellent aptitude for machining by material removal, and the ratio of alloy elements according to this invention makes it possible—with suitable parameters for material removal —to obtain sufficiently small suttings, even without chip-breaking, and a good lubricating and a very good surface quality, which makes it possible to increase considerably the removal parameter of the material used.

The steel according to this invention can be hardened or treated by hardening followed by tempering, both by a regular heat treatment and by an induction treatment, the surface hardening therefore being able, if needed, to be established and regulated in a simple way and over a wide range.

The steel according to this invention unites high resistance to dynamic stresses of mechanical construction steels, unalloyed or slightly alloyed, with excellent aptitude for machining by material removed exhibited by free-cutting steels, and further a mechanical strength obtained without hardening and which meets the needs of most modern machine elements.

This invention and the properties of the steels thus made will be better understood from the following detailed description of several embodiments taken as non-limiting examples.

EXAMPLE I

By way of example, three charges made up of the steel according to this invention are presented here. Charges 1 and 2 were made in a 70 ton arc furnace and poured in square-shaped 6.4 ton shells. Ingots were made by rolling without surface cleaning, under normal conditions, in the shape of square ingots having an edge length of 210 mm, then transformed by rolling into steel rods with a 16 mm diameter, which was air cooled on coolers.

Charge 2 was made by melting in a 60 ton arc furnace, then refined in a metallurgical installation equipped with ladles. The molten metal was poured in a continuous casting installation with four dies, square in shape, the edge length of the billets being 240 mm.

The billets were transformed, by rolling, into steel rods with a diameter of 20 mm, then air cooled on coolers. The test results are shown in the following tables.

The charges are prepared by usual metallurgical methods consisting in melting the iron charge in the furnace above indicated, in analysing the composition of the melt and in adding eventually the necessary supplementary ingredients in order to balance the composition. The molten charge is overheated at a temperature superior of about 145° F. to the temperature of the casting and then poured into refining ladles. The different powder additive as indicated in table 1 are respectively added in order to have the final composition as indicated in table 1. The content of the ladles is then poured in shells or in a continuous casting installation as indicated above.

The method and devices used are namely described by L. Bäcker and P. Gosselin Journal of Metal, May 1971 No. 23, p. 26 to p. 27.

TABLE 1

| 1.1 Chemical Composition | Chemical composition in percentages (by weight) | | | | | | | | | | | | | |
|---|---|---|---|---|---|---|---|---|---|---|---|---|---|---|
| Charge | C | Mn | Si | P | S | Pb | Nb | V | Zr | Mo | B | Bi | Ca | N |
| 1 | 0.32 | 1.32 | 0.41 | 0.015 | 0.083 | 0.27 | 0.05 | 0.03 | 0.027 | 0.11 | 0.0028 | 0.0027 | 0.005 | 0.023 |
| 2 | 0.46 | 1.36 | 0.23 | 0.013 | 0.071 | 0.25 | 0.033 | 0.05 | 0.03 | 0.045 | 0.0035 | 0.0024 | 0.0063 | 0.0197 |
| 3 | 0.65 | 1.24 | 0.37 | 0.023 | 0.10 | 0.57 | 0.041 | 0.04 | 0.02 | 0.17 | 0.0026 | 0.0030 | 0.0059 | 0.029 |

TABLE 2

| 1.2. Mechanical properties | | | | | | | | | | | | | |
|---|---|---|---|---|---|---|---|---|---|---|---|---|---|
| Designation | | rolled[1] | | | 400° C.[2] | | | 700° C.[3] | | | 1250° C.[4] | | |
| Unit of Measure | | 1. | 2. | 3. | 1. | 2. | 3. | 1. | 2. | 3. | 1. | 2. | 3. |
| $Rp^{0.002}$ | $N/mm^2$ | 570 | 640 | 809 | 650 | 700 | 863 | 500 | 532 | 700 | 600 | 744 | 900 |
| Rm | $N/mm^2$ | 800 | 920 | 1079 | 810 | 924 | 1090 | 710 | 800 | 970 | 840 | 972 | 1100 |
| $A_5$ | % | 18 | 15.5 | 14 | 19 | 15.5 | 16 | 24 | 23 | 21 | 16 | 10 | 10 |
| Z | % | 52 | 45.8 | 40 | 53 | 46.4 | 48 | 63 | 52.4 | 52 | 50 | 30 | 28 |
| KCU + 20° C. | | 7− | 6− | 6− | 10− | 7− | 6 | 16− | 8− | 7− | 7− | 5− | 4− |
| $da/J/cm^2$ | | −10 | −8 | −8 | −15 | −10 | −9 | −20 | −12 | −11 | −10 | −6 | −5 |

[1]Rolled state without heat treatment
[2]kept hot, at 400° C., for 90 minutes, the air cooled
[3]kept hot, at 800° C., for 90 minutes, then air cooled
[4]kept hot, at 1250° C., for 45 minutes, then air cooled

1.3 Aptitude for Machining by Material Removal

Checking of the aptitude for machining by material removal was made by crater wear measurements, whose critical value at K crit.=0.05 mm was determined. The check was made, during outside turning, with a single-edge tool, by hard-alloy, high-speed cutting plates, with mechanical locking. Removal of cuttings was made and check on samples of charge 1 of the steel according to this invention, which had previously undergone a detensioning treatment at 400° C., and on samples treated by hardening and tempering, of a steel used as a basis of comparison. The chemical composition of this steel used for a basis of comparison appears in Table 3, and its mechanical properties in Table 4.

TABLE 3

| | Chemical composition in percentages (by weight) | | | | | | | | |
|---|---|---|---|---|---|---|---|---|---|
| | C | Mn | Si | P | S | Cr | Ni | Cu | Al |
| Steel Used at basis of comparison | 0.47 | 0.90 | 0.27 | 0.030 | 0.09 | 0.17 | 0.12 | 0.20 | 0.08 |

TABLE 4

| Designation | | Values relating to steel used as basis of comparison, treated by hardening and tempering |
|---|---|---|
| | Unit of measure | |
| $Rp^{0.002}$ | $N/mm^2$ | 280 |
| Rm | $N/mm^2$ | 790 |
| $A_5$ | % | 19 |
| Z | % | 53 |
| Kcu + 20° C. | da $J/cm^2$ | 4–6 |

The result of the check of the aptitude for machining by material removal, made with the high-speed steel tool, is summerized in Table 5.

TABLE 5

| Material removal parameters | | Cutting life to crater wear $K_{crit}$= 0.05 mm/mn | |
|---|---|---|---|
| Designation Parameter | | Charge 1 | Steel serving as basis of comparison |
| Cutting removal speed m/mn | 70 | 240–300 | 18–22 |
| Advance mm | 0.12 | | |
| Depth of cut mm/U | 2.5 | | |
| Shape of cuttings | | Suitable for automatic machines[1] | flowing cuttings |

[1]non-continuous cuttings, not adhering to one another, finely fragmented, and able to be evacuated by cooling liquid.

The results of the check of the aptitude for machining by material removal, made with the hard-alloy tool are summerized in Table 6.

TABLE 6

| Material removal parameters | | Cutting life to crater wear $K_{crit}$= 0.05 mm/mn | |
|---|---|---|---|
| Designation Parameter | | Charge 1 | Steel serving as basis of comparison |
| Cutting removal speed m/mn | 200 | 360–480 | 28–40 |
| Advance mm | 0.10 | | |
| Depth of cut mm/U | 1.5 | | |
| Shape of cuttings | | Suitable for automatic machines | flowing cuttings |

I claim:

1. A free-cutting steel able to support dynamic stresses and exhibiting a high strength, even without hardening, and an excellent aptitude for machining by material removal, which is intended for making machine elements subjected to great stresses, consisting essentially of, besides iron, 0.1 to 0.7% (by weight) of C, 1.2 to 3% (by weight) of Mn, 0.1 to 1% (by weight) of Si, at most 0.1% (by weight) of P, 0.05 to 0.15% (by weight) of S, at least 0.1% (by weight) of Pb, 0.001 to 0.03% (by weight) of Ca, 0.001 to 0.005% (by weight) of B, 0.007 to 0.035% (by weight) of N, 0.03 to 0.2% (by weight) of Nb or V or their mixture, 0.01 to 0.25% (by weight) of Zr or Ce or their mixture, at most 0.2% (by weight) of Be or Bi or their mixture, and at most 1% (by weight) of Mo or Ni or their mixture.

2. A steel according to claim 1 consisting essentially of, besides iron,

| | | | |
|---|---|---|---|
| C | 0.1–0.7% | B | 0.001–.005% |
| Mn | 1.2–3% | N | .007–0.035% |
| Si | 0.1–1% | Nb or V or their mixture | 0.01–0.2% |
| P | 0–0.1% | Zr or Ce or their mixture | 0.01–0.25% |
| S | 0.05–0.15% | Be or Bi or their mixture | 0.001–0.2% |
| Pb | 0.1–0.6% | Mo or Ni or their mixture | 0.01–1% |
| Ca | 0.001–0.03% | | |

3. A free cutting steel according to claim 1 consisting essentially of, besides iron,

| | | | |
|---|---|---|---|
| C | 0.1–0.7% | V | 0.01–0.15% |
| Mn | 1.2–2% | Zr | 0.01–0.15% |
| Si | 0.1–1% | Mo | 0.01–0.5% |
| P | 0.0–0.04% | B | 0.001–0.005% |
| S | 0.05–0.15% | Bi | 0.001–0.005% |
| Pb | 0.1–0.6% | Ca | 0.001–0.01% |
| Nb | 0.01–0.15% | N | 0.007–0.035% |

* * * * *

UNITED STATES PATENT AND TRADEMARK OFFICE

CERTIFICATE OF CORRECTION

PATENT NO. : 4,265,660

DATED : May 5, 1981

INVENTOR(S) : Henrik Giflo

It is certified that error appears in the above—identified patent and that said Letters Patent is hereby corrected as shown below:

On the Title Page, Item [22], "July 3, 1979" should read ---- July 2, 1979 ----.

Signed and Sealed this

*Sixteenth* Day of *February 1982*

[SEAL]

*Attest:*

GERALD J. MOSSINGHOFF

*Attesting Officer*

*Commissioner of Patents and Trademarks*